United States Patent [19]

Ibrahim et al.

[11] 4,341,089

[45] Jul. 27, 1982

[54] SELF HEATING REFRIGERATOR

[75] Inventors: Fayez F. Ibrahim; Arthur Perez, both of Niles, Mich.

[73] Assignee: Tyler Refrigeration Corporation, Niles, Mich.

[21] Appl. No.: 36,661

[22] Filed: May 7, 1979

Related U.S. Application Data

[63] Continuation-in-part of Ser. No. 876,749, Feb. 10, 1978, abandoned.

[51] Int. Cl.[3] ..... A47F 3/04

[52] U.S. Cl. ..... 62/246; 62/248; 62/236; 62/453

[58] Field of Search ..... 62/275, 256, 248, 453, 62/236, 277; 312/116; 219/218

[56] References Cited

U.S. PATENT DOCUMENTS

| | | | |
|---|---|---|---|
| 2,669,853 | 2/1954 | Spiegelhalter | 62/453 |
| 3,697,723 | 10/1972 | Winsler et al. | 62/248 |
| 3,911,245 | 10/1975 | O'Shaughnessy | 62/248 |

*Primary Examiner*—Albert J. Makay
*Assistant Examiner*—Henry Bennett
*Attorney, Agent, or Firm*—LeBlanc, Nolan, Shur & Nies

[57] ABSTRACT

A refrigerated display case having a mechanism for impeding the formation of condensation around the frame of the opening of the display case or at the junction of a door and a case frame of the display case. In one preferred embodiment, the ballast used in connection with the lights on commercial refrigerators and freezers are secured to the base in a manner which allows the heat generated by the ballast to be used to raise the temperature of the case frame. In another preferred embodiment the return conduit of the refrigeration system is employed adjacent the case frame for transferring heat from the refrigerant in the conduit to raise the temperature of the case frame as well as to increase the efficiency of the refrigeration system. In both of these embodiments, electrical resistance wires are included to supplement the heating provided by the ballast and the refrigeration system to ensure that condensation is prevented from forming on a frame or other desired portions of the case. These electrical resistance wires are included with an adjustable temperature sensing circuit which places the wires in operative mode only when needed.

3 Claims, 4 Drawing Figures

SELF HEATING REFRIGERATOR

RELATED APPLICATION

The present application is a continuation-in-part of our prior application Ser. No. 876,749, filed Feb. 10, 1978, now abandoned.

BACKGROUND OF THE INVENTION

The present invention relates to mechanisms for minimizing frost buildup around the frame of an opening in a refrigerated display case, especially those having doors covering such openings.

In display refrigerators having doors which render access to the interior portion for customers, condensation near the door openings will accumulate and freeze forming frost at the joints. This typically occurs because the cabinet door will approach the temperature of the refrigeration air used in maintaining the goods on display in a frozen or refrigerated state. As a result, portions of the refrigerator door will reach a temperature well below that of the ambient air effecting condensation and possibly cause freezing of the moisture carried by the ambient air. The frozen moisture can build up to such an extent that the door will jamb thereby impairing the ability of the customer to get to the goods he wishes to purchase. In addition, it creates a rather unsightly appearance detracting from the cleanliness and sanitation environment which the retail users of such refrigeration cabinets desire to achieve. This problem is especially prevalent in the operation of refrigerated display cases having sliding type doors.

Although attempts have been made to prevent the buildup of condensation on the frame of the refrigerator, they are largely inefficient and very wasteful. An example of such an attempt is the U.S. Pat. No. 2,535,278 to Fletcher. The device illustrated in the Fletcher patent relates to the style of refrigerator which is heated by light that forms part of a warning system. The light generates heat which serves to warm the exposed surface of the case by conduction through a metal surface. In addition, the heat generated to a lesser extent warms the ambient air which rises in a channel to assist in warming the exposed surface of the case.

A similar example of such attempts to eliminate this formation of condensate includes U.S. Pat. No. 3,135,100 to Taylor et al. which discloses electrical means mounted on the door of a refrigerator to heat the door and thereby prevent the formation of condensation and frost. A transformer is included to limit the amount of voltage which is used to generate the electric current and ultimately the heat in the electrical wires. Other examples of refrigerated enclosures incorporating heating elements in the form of electrical resistance heaters include U.S. Pat. Nos. 2,858,408 to Barroero, 3,449,925 to Barroero, and 3,869,873 to Thomas. In another type of system, the heat from the refrigerant passing through the liquid lines has been used for minimizing frost in the grille covering the air inlet opening of the air conduit of a refrigerated display case; see U.S. Pat. No. 3,371,503 to Perez.

The problem which is characteristic of many of the approaches of the past is the failure to effectively use the heat generated by items which are already typically used on refrigerators for other purposes to prevent the buildup of condensation at the joints of the door and the frame. Where resistance wires have been relied upon as a sole source of heat there results an inefficiency because of the added heat to the refrigerating case which must be cooled by the refrigeration system as well as the cost of the electrical power needed to provide the electrical heating wires with current. In addition, other sources of heat have simply not been efficient in and of themselves to prevent the formation of the condensation.

SUMMARY OF THE INVENTION

An object of the invention is to provide a more efficient method and apparatus for raising the temperature of the frame above the dew point to avoid the accumulation of condensation.

Another object of the present invention is to include a supplementary heating mechanism for avoiding the accumulation of frost when the primary heating mechanism is not in operation.

A further object of the present invention also is to use other elements such as lights, typically present in refrigerated display cases, which elements have a primary purpose to provide energy for other items and extract a portion of that heat for delivery to an area of the case frame adjacent the opening in the case or the door for avoiding the accumulation of frost thereon.

A still further object of the present invention is to reduce the amount of energy required in avoiding or preventing the accumulation of frost at the joint between the door and the case frame.

Still another object of the present invention is to use a portion of the liquid refrigerant in a return line in the area of the case frame adjacent the door or the opening in the case to prevent the accumulation of condensation thereon and simultaneously raise the efficiency of the refrigeration system.

The present invention as disclosed herein generally relates to a refrigerated display case having a more effective mechanism for impeding the formation of condensation such as at the joint between the door and the frame of a refrigerator case, thereby avoiding the problems which have plagued the prior art, examples of which have been discussed above. All of the objectives stated above are achieved by the provision of a refrigerated display case in accordance with the present invention.

In accordance with the preferred embodiments of the present invention, the refrigerated display case includes a cabinet having side walls for containing the goods to be sold in the interior portion of the case and a refrigeration system for maintaining these goods in a refrigerated state. Incorporation of the present invention is particularly beneficial in frozen food cases, although it can be utilized in other types of refrigerated cases. The types of display cases can include open front cases, open top cases and glass door merchandisers.

In a glass door merchandiser case, a glass door is provided along one side of the refrigerated case and forms a joint with the frame. The frame, in the vicinity of the area where the door comes in contact with the frame to seal the refrigerator, carries a ballast and light fixture for illuminating the refrigerator so that the goods displayed therein can be more readily seen by the customers. The ballast is secured directly to a portion of the frame so that at least part of the heat generated by the ballast in lighting a fluorescent bulb is conducted to the frame in the area adjacent the door when it is in the closed disposition. The heat conducted is sufficient to raise the temperature of the frame above the dew point, thereby avoiding the accumulation of condensation at the joints.

In addition, in the glass door merchandiser described above, electrical resistance wires are maintained in contiguous relationship to a part of the frame for raising the temperature of the frame above the dew point when the lights and accompanying ballast are not in operation. In this way, the accumulation of condensation is prevented even when the lights are turned off.

In a modified embodiment of the glass door merchandiser of the present invention, liquid lines from the refrigeration system are located adjacent the frame to heat the portion of the frame adjacent the door above the dew point, thereby avoiding an accumulation of condensation in a manner similar to that of the ballast mentioned above. It is well known to those skilled in the art, that a portion of the liquid line used in refrigeration systems is at a relatively high temperature before it is delivered to an evaporator where the refrigerant is expanded for reducing its temperature significantly to accomplish the refrigeration. After the heat has been transferred from the interior refrigerator to the coils, the refrigerant with the absorbed heat is compressed to a state where the temperature is raised above that of the surrounding atmosphere. In this raised temperature state, the refrigerant is delivered to a heat exchanger where the heat from the compressed refrigerant is returned to an expansion valve feeding the evaporator.

By placing a portion of this return line in the area of the case frame as explained, not only is the case frame heated above the dew point, but also, the efficiency of the refrigeration system is enhanced. During the refrigeration cycle, by sub-cooling the liquid refrigerant prior to its delivery to the expansion valve, the efficiency of the system is enhanced. For each decrease of 10° F. in the temperature of the liquid refrigerant, the efficiency of the display case is increased by 5%.

A combination of the electrical resistance wires and liquid lines also can be used in other types of display cases, such as open top cases. In the utilization of open top display cases, it is necessary to maintain the grilles at the air outlet and air inlet openings free of any frost buildup. Any frost buildup on the air grilles eventually can cause blockage of the openings in the grille thereby interrupting the air flow. The utilization of the electrical resistance wires and liquid lines mounted in the area around the grille serves to maintain the temperature above the dew point which has the effect of minimizing frost buildup.

In the operation of the combination of the electrical resistance wires and the liquid lines, the liquid lines serve as the primary heat source and the electrical resistance wires are a secondary source that only are used when necessary. A thermostatic control can be coupled with the electrical resistance wires so that the wires only are turned on when either the temperature around the grille drops below a preselected level or during the defrost cycle. This pre-selected level can be adjustable by inclusion of a thermostat in the circuit.

Thus, it can be seen that the use of liquid lines, in the manner explained, produces dual advantages of avoiding the accumulation of condensation and raising the efficiency of the refrigeration unit.

DESCRIPTION OF THE PREFERRED EMBODIMENTS

Figure 1:
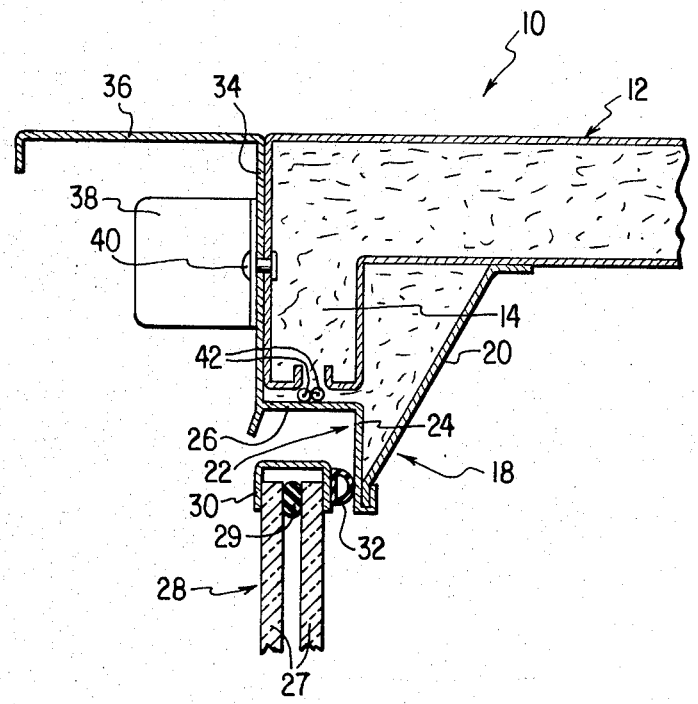
FIG. 1 is a fragmentary cross-sectional view of a refrigerated display case having an insulated glass door where a portion of the case frame carries a ballast for heating a fluorescent light.

Referring now to FIG. 1, there is shown a partial cross section of a refrigerated display case 10 showing an L-shaped top 12 to which is secured a bracket 18 which forms part of frame 22 of the display case. The L-shaped top 12 includes a short leg 14 which extends downwardly adjacent a portion of case frame 22. A support arm 20 supports case frame 22; support arm 20 extends rearwardly and is connected to the top 12. The bottom of support arm 20 is connected to front face surface 24 of case frame 22. Top face surface 26 of the frame 22 extends outwardly from front face 24 and is located adjacent bottom surface 16 of short leg 14.

A door 28 is formed of two glass sheets 27 in parallel relationship spaced from each other by an insulator 29 for insulating the internal portions of the refrigerator from the ambient air. A door frame 30 is secured about the edge portion of glass sheets 27. Door frame 30 carries a flexible sealing member 32 facing inwardly for contact with front face surface 24 of door jamb 22 when the door is in the closed position, as shown in the drawing. In its closed position, the door presses flexible sealing member 32 against front face surface 24 of frame 21 to seal the internal areas of the refrigerated display case from the surrounding ambient air.

Extending from the outermost portion of front face surface 24 is an upright member 34 which carries ballast 38 and its corresponding fluorescent light bulb which is not shown in this view. A roof 36 extends from the top of upright member 34 for covering ballast 38 and the fluorescent light bulb. Roof 36 also serves to reflect the light from the fluorescent light bulb downwardly into the display case. Ballasts 38 are secured to upright member 34 by rivets 40. These rivets are made of heat conductive material so that the heat generated by the ballasts in operating the fluorescent lights can travel through the rivets into upright member 34 to front face surface 24 and top face surface 26 of case frame 22 for raising the temperature of case frame 22 above the dew point thereby preventing the accumulation of condensation and frost buildup.

In addition, electrical wires 42 are provided adjacent top face surface 26 and beneath the bottom surface of leg 14 of top 12. The electrical wires and the ballasts are integrated with a control circuit for alternatively actuating ballasts 38 and electrical resistance wires 42. A double throw switch can be incorporated so that when the lights are turned on, the electrical heater wires are turned off. Alternatively, when the lights are turned off, the electrical wires are activated. In this way, there will always be a sufficient heat supply to the case frame for preventing the accumulation of condensation and frost buildup. By using this type of alternative method, it is possible to avoid the duplication of energy to the area of case frame 22 which otherwise would occur if both electrical wires 42 and ballasts 38 were operated simultaneously. By relying on the heat generated by the ballasts, energy needed to run the electrical wires is eliminated thereby providing substantial savings in the costs of running these refrigerated display cases in a commercial establishment. This is particularly true where there are several such refrigerated display cases in the commercial establishment. Over long periods of time, the amount of energy saved by relying on the ballasts used in the lighting mechanism in lieu of electrical resistance wires is substantial.

Figure 2:
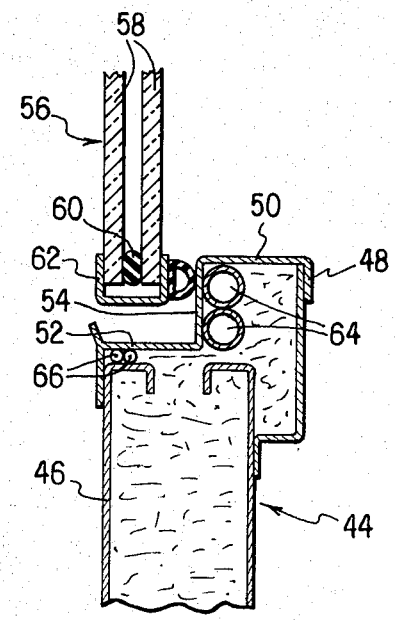
FIG. 2 is a partial sectional view of a refrigerated display case showing liquid lines adjacent the frame of the case.

In another embodiment, as shown in FIG. 2, a refrigerated display case 44 includes a case portion 46 which carries a case frame 48 having an upper face 50 and a lower face 52 connected by offset face 54, as shown in the drawing. Door 56 is similar to door 28, as shown in FIG. 1, in that it has two glass sheets 58 separated by an insulator 60 which allows the goods being displayed to be readily seen by the customer but prevents heat transfer through the door because of the air gap provided between the glass sheets. Liquid lines 64 are provided adjacent offset surface 54 of case frame 48. In addition, electrical resistance wires 66 are provided adjacent lower surface 52 of case frame 48 to supplement the heating by liquid lines 64.

Figure 3:
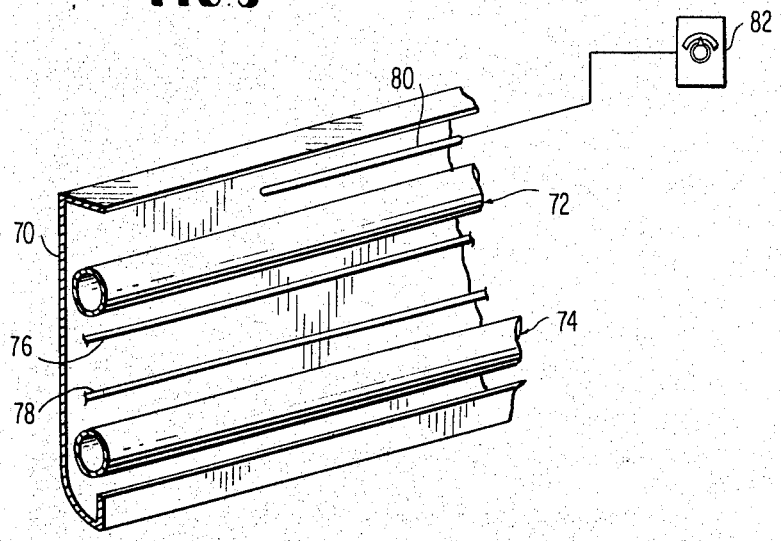
FIG. 3 is a perspective view of a portion of a heating source for a grid divider.

In a further embodiment, a grid divider 70 as shown in FIG. 3, is provided with a heat source for avoiding frost buildup. The heat source is formed by the combined use of liquid lines 72 and 74 and electrical resistance wires 76 and 78. The heat given off by the refrigerant flowing through lines 72 and 74 provides the primary heat source for maintaining the grid divider above the dew point. If the temperature at grid divider 70 should fall below the dew point, such as during a defrost cycle of operation, at which time the flow of refrigerant is stopped, then electrical resistance wires 76 and 78 can be activated. The electrical resistance wires serve as a secondary heat source for ensuring that the temperature of the grid divider remains at or above the dew point. A temperature sensing element 80 for sensing the temperature along the grid divider and an adjustable thermostat 82 are coupled to electrical resistance wires 76 and 78 for controlling the operation of the wires.

Figure 4:
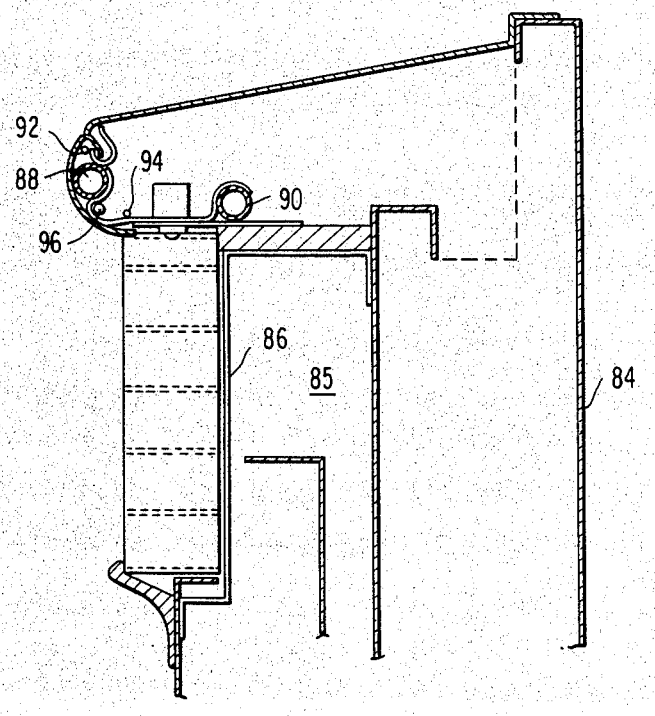
FIG. 4 is a partial sectional view of an air outlet section of an open top refrigerated display case.

A heat source of the type shown in FIG. 3 also can be utilized for maintaining the area of the grilles covering the air outlet and air inlet openings of the air conduit of a refrigerated display case at a temperature above the dew point. The two openings in the conduit serve to establish an air curtain across the access opening in the display case. An embodiment using a heat source in this manner is shown in FIG. 4, where a grille 86 covers the air outlet opening of an air conduit 85 of a refrigerated display case 84. Arranged in the space above grille 86 are liquid lines 88 and 90, electrical resistance wires 92 and 94 and temperature sensing element 96. The operation of the heat source is the same as that described above with respect to the embodiment shown in FIG. 3.

The basic system used in refrigerating cases is generally known to those skilled in the art. The system includes an evaporating coil which receives refrigerant through a refrigerant supply conduit or return line from a condenser. Intermediate the condenser and the evaporator is a compressor which draws the expanded gaseous refrigerant from the coil and compresses it substantially which in turn, raises the temperature of the fluid as it is condensed in the condenser. The condenser is usually located outside the refrigerator and in its high pressure, high temperature state, exchanges heat with the atmosphere to lower the temperature and transform the gas into liquid. Typically, this liquid refrigerant is returned to the expansion valve which expands the refrigerant to a relatively low pressure causing the temperature to be depressed significantly, resulting in the refrigeration of the case by heat transfer out of the case to the low temperature refrigerant.

In the embodiment shown in FIG. 2, a portion of the return conduit between the condenser and the expansion valve is located adjacent to the offset surface 54 of the case frame 48. This relatively high temperature liquid refrigerant, passing through the liquid line 64 will heat the case frame sufficiently to avoid accumulation of condensation thereon. The embodiments shown in FIGS. 3 and 4 operate in a similar manner.

In addition, the operation of the refrigeration system is enhanced because of the heat that is withdrawn from the liquid refrigerant in line 64. As a result, the liquid refrigerant is even further depressed in temperature from what it would normally be in passing through the condenser alone. When the refrigerant is delivered at this lower temperature to the expansion valve and expanded through the evaporator, the temperature in the evaporator is similarly lower than what it would otherwise be thereby enhancing its refrigerating characteristics. The consequence is an increase in efficiency of the refrigeration system as well as the avoiding of condensation in the area of the case frame.

Electrical resistance wires 66 operate in the same manner as wires 42 of the system shown in FIG. 1. That is, when a refrigeration system is shut down, the electrical resistance wires will automatically be activated to further heat the case frame to ensure that condensation will not accumulate. In the embodiments of FIGS. 3 and 4, the electrical resistance wires can be actuated simultaneously with the operation of the liquid lines whenever necessary.

By having the electrical wires, the condensation accumulation will be prevented even during periods when the refrigeration system is closed down. In addition, there may be times when the use of the ballast or the liquid lines will not be sufficient in and of themselves to raise the temperature of the case frame above the dew point. In those situations, a control system, such as shown in FIGS. 3 and 4, can be incorporated with the electrical wires to supplement the heating effects of the ballast or the liquid lines. Such a control system also can be used in the embodiments shown in FIGS. 1 and 2.

Thus, from the above description, it can be seen that there are many advantages and energy saving and efficiencies gained from the systems described. The embodiment of this inventive concept illustrated herein is exemplary and not exhaustive, the invention not being limited thereto since modifications and variations thereof may be made through a wide range without departing from the spirit and scope of the invention as set forth in the appended claims.

What is claimed is:

1. A refrigeration display case including a cabinet having an opening therein, a refrigerator door covering the opening and apparatus for preventing the formation of condensation at the junction of the refrigerator door and jamb for the door, said display case comprising: a refrigeration system for cooling the interior of said case, said system including an evaporator, a compressor, a condenser, and an expansion valve; said expansion valve being located upstream of said evaporator for expanding refrigerant delivered thereto through said evaporator for cooling said case, said compressor being located downstream of said evaporator for receiving the refrigerant expanded through said evaporator, said compressor compressing the refrigerant and delivering such refrigerant to a condenser located downstream of said compressor, said condenser condensing the refrigerant and being connected to a return conduit for returning the liquid refrigerant to the expansion valve; a portion of said return conduit being located adjacent the portion of said case frame surrounding said refrigerator door for heating and maintaining said case frame and said door jamb above the dew point during the operation of said refrigeration system thereby preventing condensation from accumulating thereon in the area surrounding said refrigerator door; the refrigerant being further cooled by heat transfer when passing through said portion of said return conduit adjacent to said case frame prior to returning to said expansion valve for expansion through said evaporator; and electrical resistance wires being located adjacent said case frame around said refrigerator door jamb, said electrical resistance wires being connected to an electrical source, said resistance wires being energized when refrigerant is not flowing through said return conduit for providing sufficient heat to raise said case frame above the dew point.

2. A display case according to claim 1 wherein said electrical resistance wires are located adjacent said door jamb, said electrical resistance wires are capable of being activated to provide supplemental heat to prevent the accumulation of frost on said case frame, so that heat from said electrical resistance wires and heat from the refrigerant passing through said return conduits in combination raise the temperature of said case frame above the dew point.

3. A display case according to claim 1 further comprising a control means coupled to said electrical resistance wires for activating said wires when said refrigerated system is inoperative and for deactivating said wires when said refrigeration system is operative to maximize the use of energy for preventing condensation accumulation on said case frame.

* * * * *